US007868839B2

(12) United States Patent
Gonzalez

(10) Patent No.: US 7,868,839 B2
(45) Date of Patent: Jan. 11, 2011

(54) PLANAR SCANNER ANTENNA FOR HIGH FREQUENCY SCANNING AND RADAR ENVIRONMENTS

(75) Inventor: Daniel G. Gonzalez, Topanga, CA (US)

(73) Assignee: Communications & Power Industries, Inc., Palo Alto, CA (US)

( * ) Notice: Subject to any disclaimer, the term of this patent is extended or adjusted under 35 U.S.C. 154(b) by 589 days.

(21) Appl. No.: 11/933,103

(22) Filed: Oct. 31, 2007

(65) Prior Publication Data

US 2010/0039338 A1 Feb. 18, 2010

(51) Int. Cl.
*H01Q 19/06* (2006.01)
*H01Q 3/10* (2006.01)

(52) U.S. Cl. ..... 343/754; 343/757; 343/756; 343/758; 343/909

(58) Field of Classification Search ..... None
See application file for complete search history.

(56) References Cited

U.S. PATENT DOCUMENTS 4,905,014 A 2/1990 Gonzalez et al.
5,675,349 A * 10/1997 Wong ..... 343/910
6,150,991 A 11/2000 Hulderman
6,346,918 B1 * 2/2002 Munk ..... 343/756
6,473,057 B2 * 10/2002 Monzon ..... 343/909
7,564,419 B1 * 7/2009 Patel ..... 343/756
7,639,207 B2 * 12/2009 Sievenpiper et al. ..... 343/909
2003/0214456 A1 * 11/2003 Lynch et al. ..... 343/909
2007/0285327 A1 * 12/2007 Paschen et al. ..... 343/754
2008/0055188 A1 * 3/2008 Lynch ..... 343/909

* cited by examiner

*Primary Examiner*—Trinh V Dinh
(74) *Attorney, Agent, or Firm*—Hoffmann & Baron, LLP

(57) ABSTRACT

A planar scanning antenna is configured for scanning and tracking. In one embodiment, the planar scanning antenna may include a transducer module configured to provide an electromagnetic beam. According to another aspect of the invention, the apparatus may include a first planar dielectric element having an axis of rotation and configured to direct an electromagnetic beam. In one embodiment, a second planar dielectric element oriented adjacent to the first planar dielectric element and having the axis of rotation may be configured to direct electromagnetic energy. The apparatus may further include a mounting structure arranging the transducer module and the first and second planar dielectric elements. In yet another embodiment, the apparatus may include a drive means for positioning the first planar dielectric element independently from the second planar dielectric element.

18 Claims, 8 Drawing Sheets

PLANAR SCANNER ANTENNA FOR HIGH FREQUENCY SCANNING AND RADAR ENVIRONMENTS

FIELD OF THE INVENTION

The present invention relates in general to antennas for scanning and radar applications, and more particularly to a planar scanner configured to utilize one or more planar dielectric elements arranged with an antenna to provide conical scanning.

BACKGROUND

Scanning antennas have been used for communication and radar systems utilizing conical scanning and tracking techniques. Conventional scanning techniques utilize beam steering through switching of antenna elements or by changing the relative phases of the radio frequency signal driving the elements. However, conventional antenna systems are not well suited to meet the demands of current requirements. Typical scanning antennas require an enormous number of electronically controlled active elements, yielding designs with increased complexity and enormous development costs. Such antennas systems are vulnerable to lens loss, interface matching, drive motor speed and control. In addition, applications of such antenna systems are limited by physical requirements imposed on the antenna design.

While conventional antenna structures provide conical scanning and tracking, antenna requirements do not suit applications limiting the geometry and complexity of the antenna design. Accordingly, there is a need in the art for an improved planar scanning antenna design.

BRIEF SUMMARY OF THE INVENTION

Disclosed and claimed herein is an apparatus for a planar scanning antenna. In one embodiment, the apparatus includes a transducer module configured to provide an electromagnetic beam. The apparatus may further include a first planar dielectric element having an axis of rotation and configured to direct an electromagnetic beam, as well as a second planar dielectric element oriented adjacent to the first planar dielectric element and also having the axis of rotation and configured to direct electromagnetic energy. The apparatus may further include a mounting structure arranging the transducer module, the first planar dielectric element and second planar dielectric element. According to another embodiment of the invention, the apparatus includes a drive means for positioning the first planar dielectric element independently from said second planar dielectric element.

Other aspects, features, and techniques of the invention will be apparent to one skilled in the relevant art in view of the following detailed description of the invention.

DETAILED DESCRIPTION OF EXEMPLARY EMBODIMENTS

Figure 1:
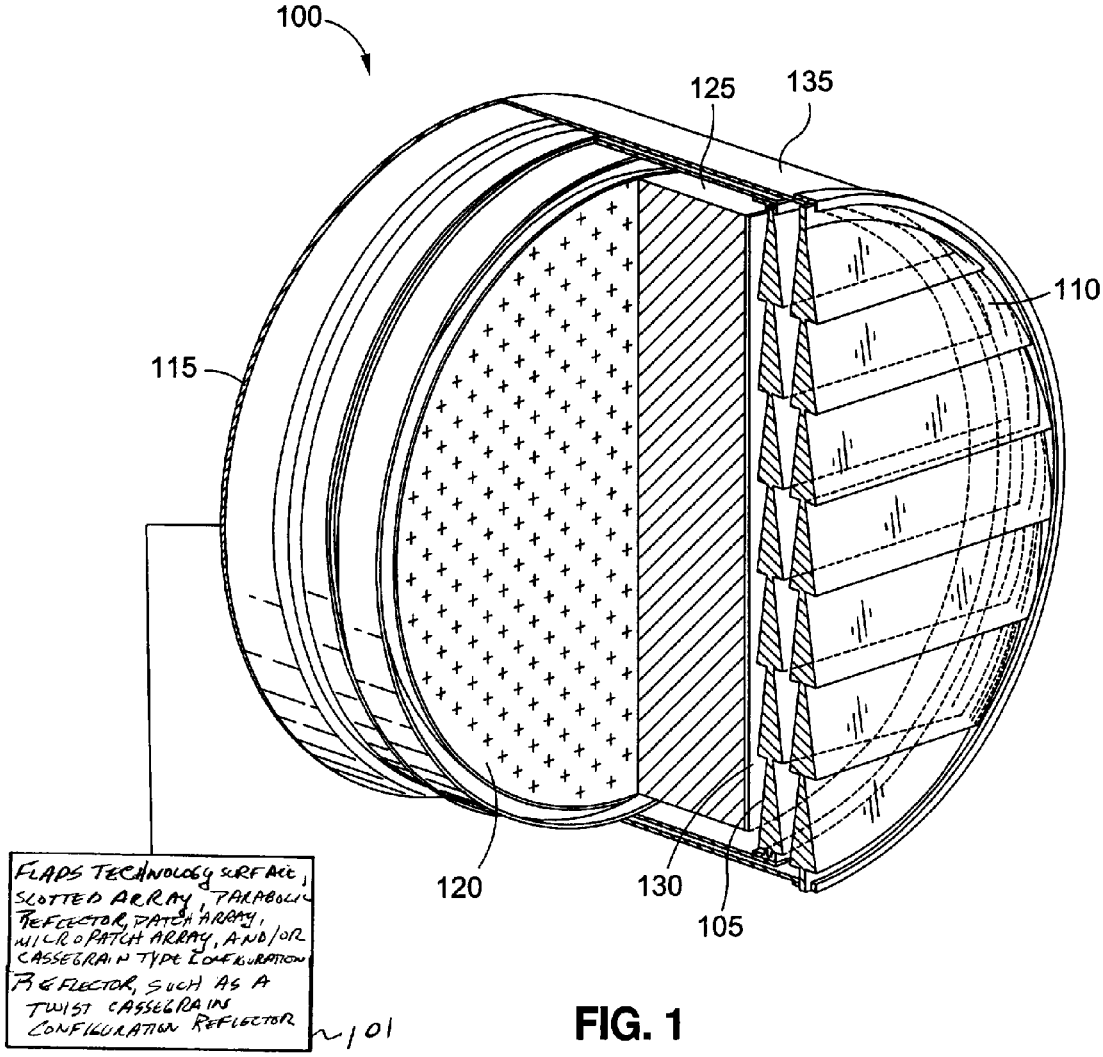
FIG. 1 depicts an embodiment of a planar scanning antenna.

One aspect of the invention is to provide a planar scanning antenna having a compact structure applicable to scanning and tracking applications. In one embodiment, a planar scanning antenna may include a transducer module, a first planar dielectric element, a second planar dielectric element and a mounting structure, wherein the transducer module first and second planar dielectric elements and a drive means are arranged by the mounting structure. The transducer module may be configured to provide an electromagnetic beam. According to another embodiment of the invention, the first planar dielectric element may have an axis of rotation normal to the transducer module and further configured to direct said electromagnetic beam. The second planar dielectric element may be oriented adjacent to the first planar dielectric element having the same axis of rotation, and configured to direct electromagnetic energy.

According to another embodiment of the invention, planar dielectric elements may be configured to impart a phase shift on incident electromagnetic energy applied to the elements. A drive means may be used to provide positioning of the first planar dielectric element independently from said second planar dielectric element. Similarly a transducer module may also be configured to provide a collimated beam source from one of a slotted array, a parabolic reflector, a micropatch array, horn assembly and horn array.

Another aspect of the invention is to provide a mounting structure for a planar scanning antenna of the invention. The mounting structure may be configured to provide independent rotation of a plurality planar dielectric elements arranged by the mounting structure. The mounting structure may include inner and outer tubes configured to be coupled to a first and second planar dielectric elements respectively. In certain embodiments, the mounting structure may further be provided for coupling a transducer module and associated feed horn, and be configured as a cylindrical package providing flush mounting to a planar structure.

With respect to a flush mounted embodiment, it can be appreciated that the antenna may be configured to be mounted to a structure such that the scanning aperture is flush with the surrounding structural surface. According to an additional embodiment of the invention, the scanning antenna may be implemented in one or more of a shipboard structure, vehicle structure and communications structure.

As used herein, the terms "a" or "an" mean one or more than one. The term "plurality" mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means any of the following: A; B; C; A and B; A and C; B and C; A, B and C. An exception to this definition will occur only when a combination of elements, functions, steps or acts are in some way inherently mutually exclusive.

Reference throughout this document to "one embodiment", "certain embodiments", "an embodiment" or similar term means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner on one or more embodiments without limitation.

Referring now to FIG. 1, depicted is one embodiment of an antenna structure 100 configured in accordance with the principles of the invention. As shown, antenna structure 100 includes a first planar dielectric element 105 and a second planar dielectric element 110. First and second planar dielectric elements 105 and 110, may be configured to independently impart a phase shift on electromagnetic energy applied to the elements. It may be appreciated that the first and second planar dielectric elements includes any combination of a lens, dielectric wedges and phase-directing surfaces. In one embodiment, planar dielectric elements 105 and 110 may further comprise one of a stepped lens and constrained lens.

Continuing to refer to FIG. 1, antenna structure 100 may also include a drive means 115, electromagnetic loading structure 120, spacer 125 and sub-reflector 130. In one embodiment of the invention, the antenna structure 100 may be configured to provide a collimated beam of electromagnetic energy in a fixed direction. To that end, electromagnetic loading structure 120, spacer 125 and sub-reflector 130 may be configured to generate such a collimated beam. Antenna structure 100 may further include so-called Flat Parabolic Surface (FLAPS) technology surface 101 as generally described in U.S. Pat. No. 4,905,014 to Gonzalez et al., as shown in FIG. 1. According to another aspect of the invention, antenna structure 100 may include a slotted array, parabolic reflector, patch array, micropatch array and/or cassegrain type configuration reflector, such as a twist cassegrain configuration reflector 101, as shown in FIG. 1. According to a further embodiment of the invention, spacer 125 may be one or more of a foam material, dielectric material and air gap.

With respect to the drive means 115, independent rotation of planar dielectric elements 105 and 110 may be provided for steering of electromagnetic energy. In one embodiment of the invention, the drive means may be provided by a motor. Tube assembly 135 may be configured to couple planar dielectric elements 105 and 110 to drive means 115 such that planar dielectric elements 105 and 110 may be rotated continuously about an axis normal to a major surface of the elements. According to another embodiment, drive means may be configured to rotate planar dielectric elements 105 and 110 at one or more of a constant speed and variable speeds. It may further be appreciated drive means may rotate each of the planar dielectric elements 105 and 110 at respective speeds and directions. Similarly, drive means may rotate planar dielectric elements 105 and 110 to at least one desired position and hold the elements at the desired position for a period of time. It should further be appreciated that antenna structure 100 may be configured to provide a continuous scan over a conical region of ±45 degrees about the antenna structure 100 normal.

Figure 2:
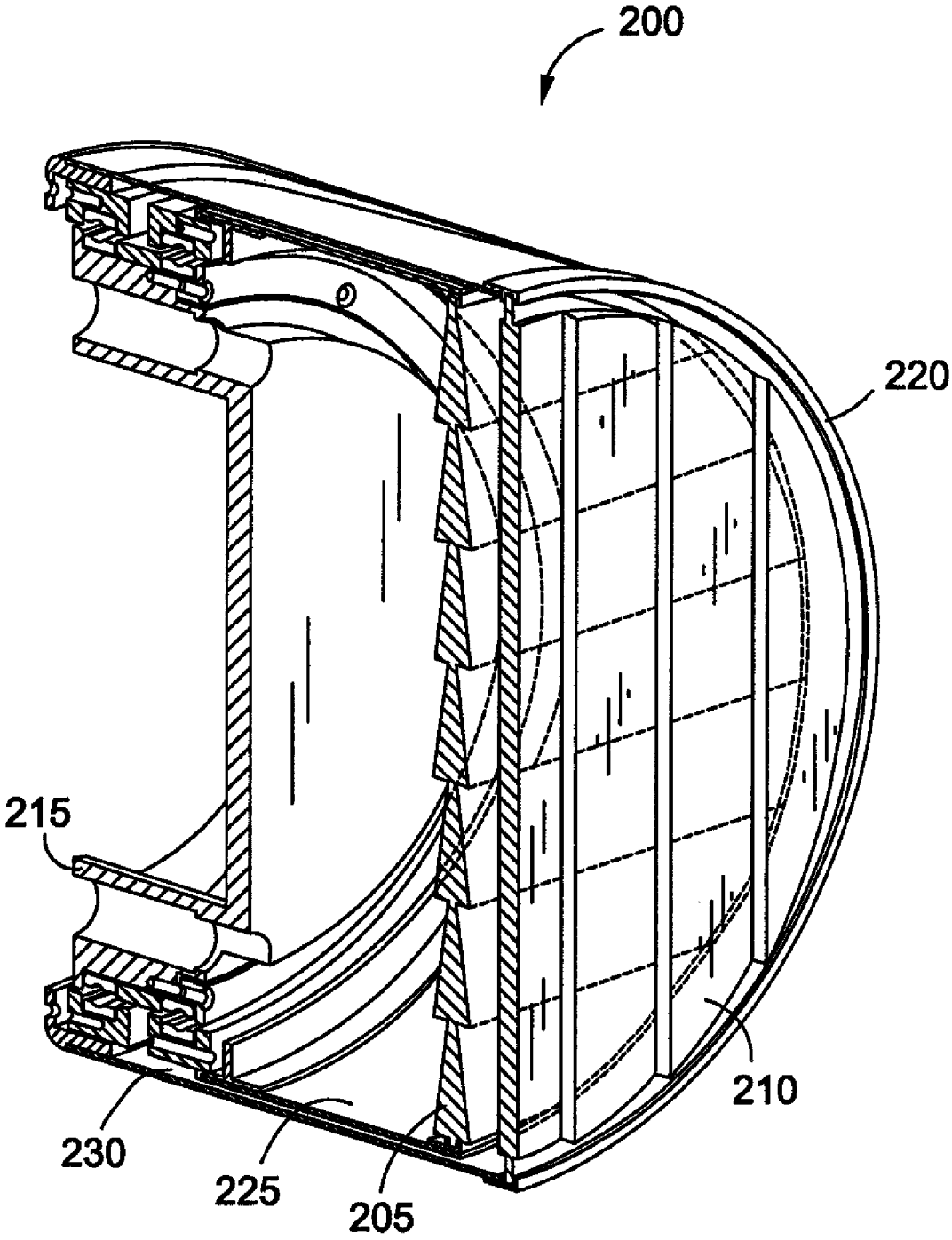
FIG. 2 depicts an embodiment of mounting means for the planar scanning antenna of FIG. 1.

Referring now to FIG. 2, a mounting structure 200 is depicted according to one embodiment of the invention. As shown, the mounting structure 200 may include support for a first planar dielectric element 205, support for a second first planar dielectric element 210, mount 215, lens coupling 220, inner drive tube 225 and outer drive tube 230. The first and second planar dielectric elements 205 and 210 may be coupled to inner drive tube 225 and outer drive tube 225, respectively. In one embodiment, a planar dielectric element (e.g., first planar dielectric element 210) may be coupled to a drive tube (e.g., outer drive tube 230) by coupling 220. Coupling may be provided by a bonded assembly in one embodiment of the invention. In another embodiment of the invention, drives means (e.g., drive means 115) may be coupled to mount 215 and may provide independent rotation of planar dielectric elements 205 and 210. Mounting structure may include planar dielectric elements 205 and 210 which are rotatable about an axis normal to a major surface of the elements. Mounting structure 200 may be further configured to support one of more of a feedhom (not shown) and spacer 125. In one embodiment, mounting structure 200 may be further configured to provide an air gap.

Figure 3:
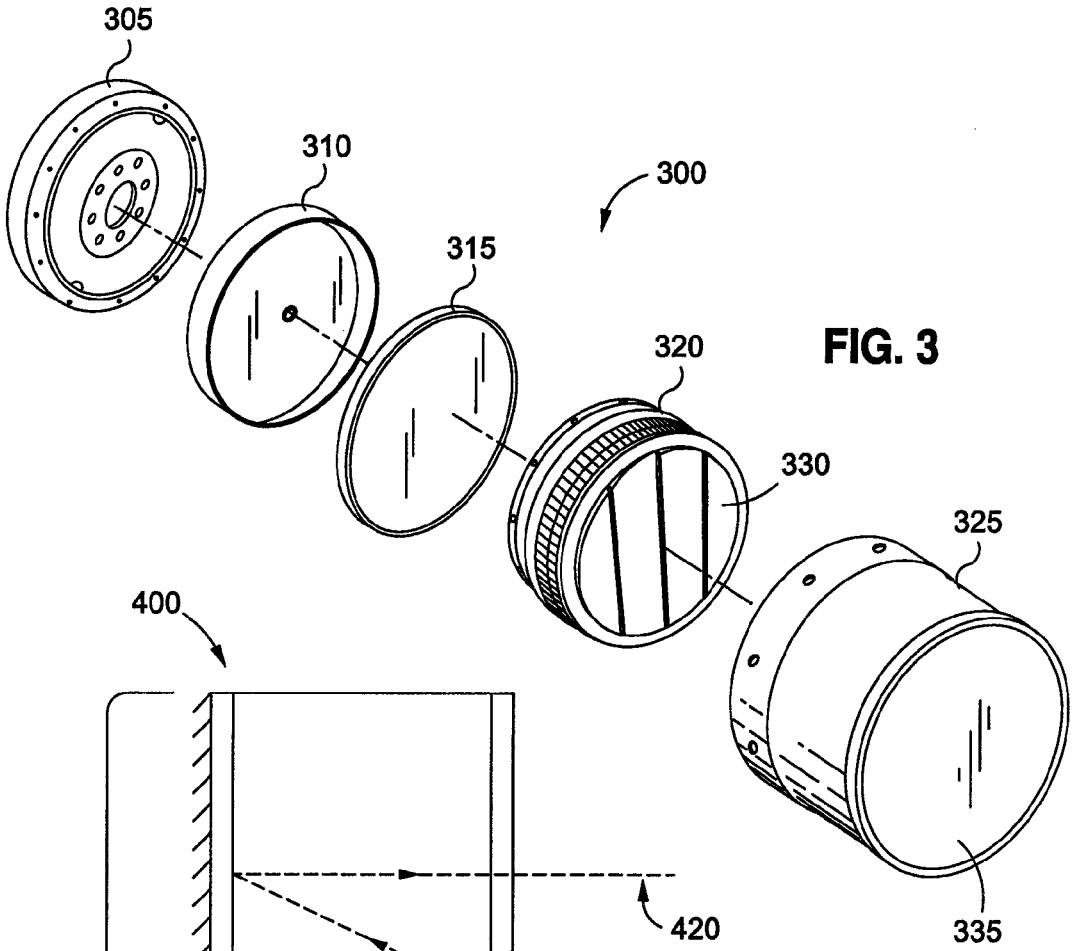
FIG. 3 depicts a disassembled antenna arrangement according to one embodiment of the planar scanning antenna of FIG. 1.

Referring now to FIG. 3, a disassembled view is depicted of planar scanning antenna 300, according to one embodiment of the invention. As shown, planar scanning antenna 300 may include motor 305, collimating surface 310, sub-reflector 315, a first planar dielectric element 330 and second planar dielectric element 335. Sub-reflector 315 may be coupled to collimating surface 310 as shown to provide a collimated beam source. Collimating surface 310 and sub-reflector 315 may then coupled to motor 305. First planar dielectric element 330 and second planar dielectric element 335 may be coupled to inner drive tube 320 and outer drive tube 325 respectively. Planar scanning antenna 300 may be assembled through coupling of inner drive tube 320 with first planar dielectric element 330 to motor 305 and concentrically overlying outer drive tube 325 with first planar dielectric element 335 to motor 305.

Figure 4:
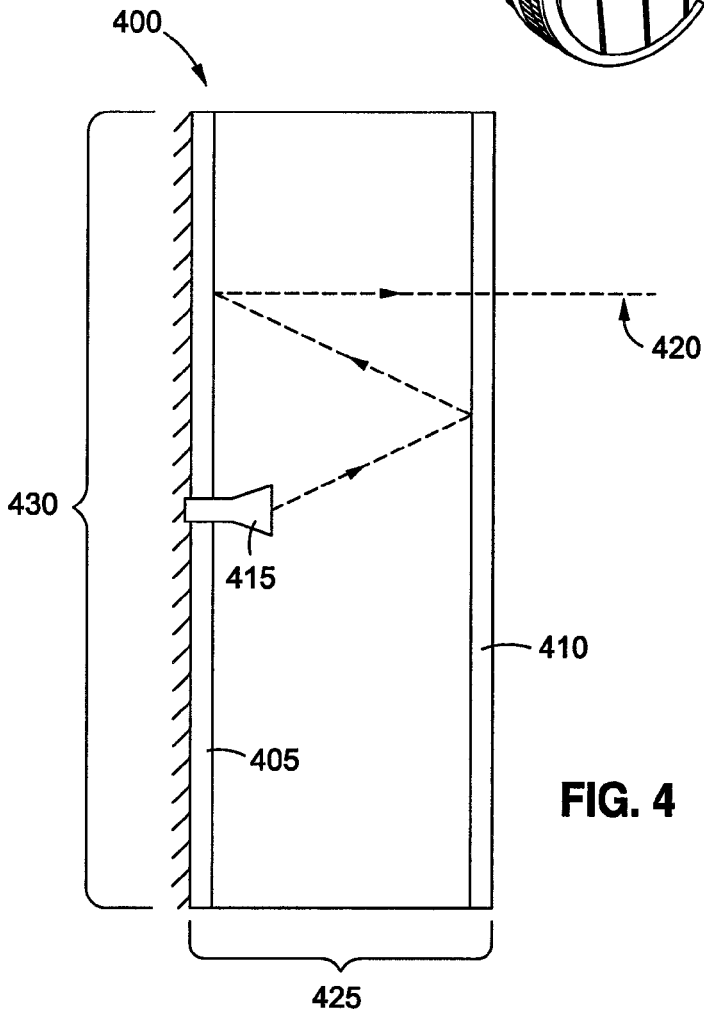
FIG. 4 depicts an embodiment of elements of the planar scanning antenna of FIG. 1.

Referring now to FIG. 4, a transducer module 400 is depicted according to one or more embodiments of the invention. In one embodiment, transducer module 400 may include electromagnetic loading surface 405, sub-reflector 410 and feedhom 415. In one embodiment, feedhom 415 may provide electromagnetic energy which may be applied to the electromagnetic loading surface 405 and sub-reflector 410 so as to provide a collimated beam of electromagnetic energy 420 of a particular frequency. It should be appreciated that transducer module 400 may be configured to be operable within various frequency ranges. By one example, transducer module 400 may be configured to be operable in the microwave frequency band.

Electromagnetic loading surface 405 may be separated from sub-reflector 410 by a distance 425. In one embodiment, insulating foam (e.g., spacer 125 of FIG. 1) may be provided between the electromagnetic loading surface 405 and sub-reflector 410. According to another aspect of the invention, electromagnetic loading surface 405 may have a dimension 430 to meet requirements of a prescribed system. As such, for scanning and radar applications, sub-reflector 410 and distance 425 may correspond to at least one of an operational frequency range and size limitations imposed by a mounting structure. Distance 425 and length 430 may be set to provide a desired operation. In one embodiment, distance 425 may be on the order of 2.5 inches, while length 430 of the loading surface 405 may be 5 inches. It may further be appreciated that distance 425 and length 430 may be provided such that to be within ⅓ to ⅔ the focal distance of the reflector.

Figure 5:
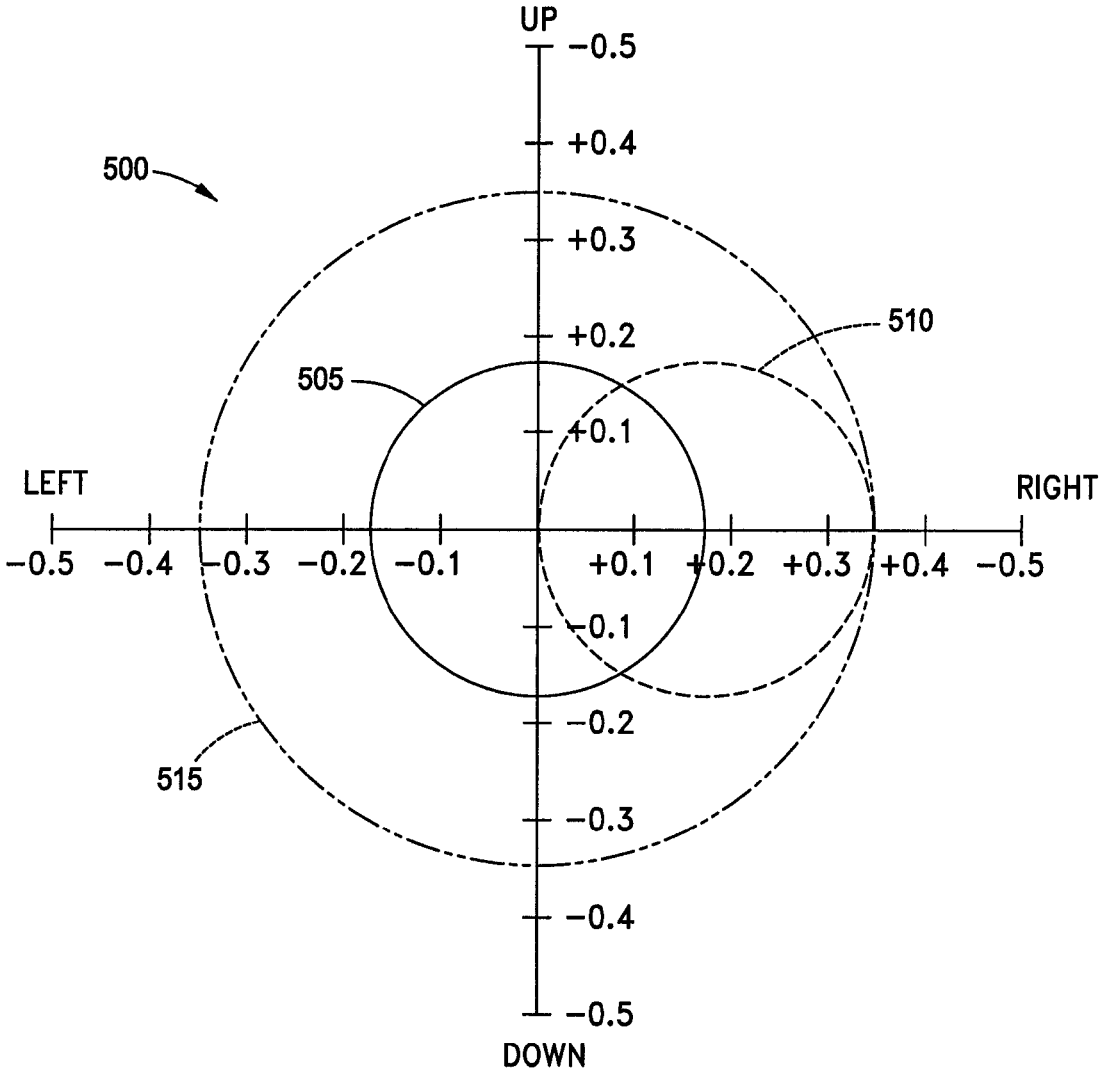
FIG. 5 depicts a scan diagram according to one embodiment, for the planar scanning antenna of FIG. 1.

Referring now to FIG. 5, a graphical representation of antenna scan pattern 500 is depicted according to one embodiment of the invention. Collimated beam source (e.g., transducer module 400) may be applied to a first dielectric element (e.g., first planar dielectric element 105), wherein a scan pattern may be generated with a beam peak corresponding to locus 505 as the first dielectric element is rotated. According to another embodiment, rotating a second dielectric element (e.g., second planar dielectric element 110)

arranged in front of the fixed first dielectric element may generate scan pattern 510. In this fashion, by independently rotating the first and second dielectric elements arranged in front of a collimated beam source, an overall scan pattern 515 may be obtained. It should be appreciated that a planar scanning antenna according to one of more embodiments of the invention may be configured to provide scanning to any point within scan pattern 515. In certain embodiments, antenna scan pattern 515 may be described by the linear addition of the sine of two planar dielectric refraction angles corresponding to the first and second planar dielectric elements as characterized by the following:

$$(\sin(\theta_{max}))=\sin(\theta_{element\ 1})+\sin(\theta_{element\ 2}))$$

where, $\theta_{element\ 1}$=angular offset imparted by the first planar dielectric element, $\theta_{element\ 2}$=angular offset imparted by the second planar dielectric element, $\theta_{max}$=resultant angular offset.

According to an additional embodiment of the invention, scanning may be provided at any point within antenna scan pattern 515 on the order of fractions of a second.

Figure 6:
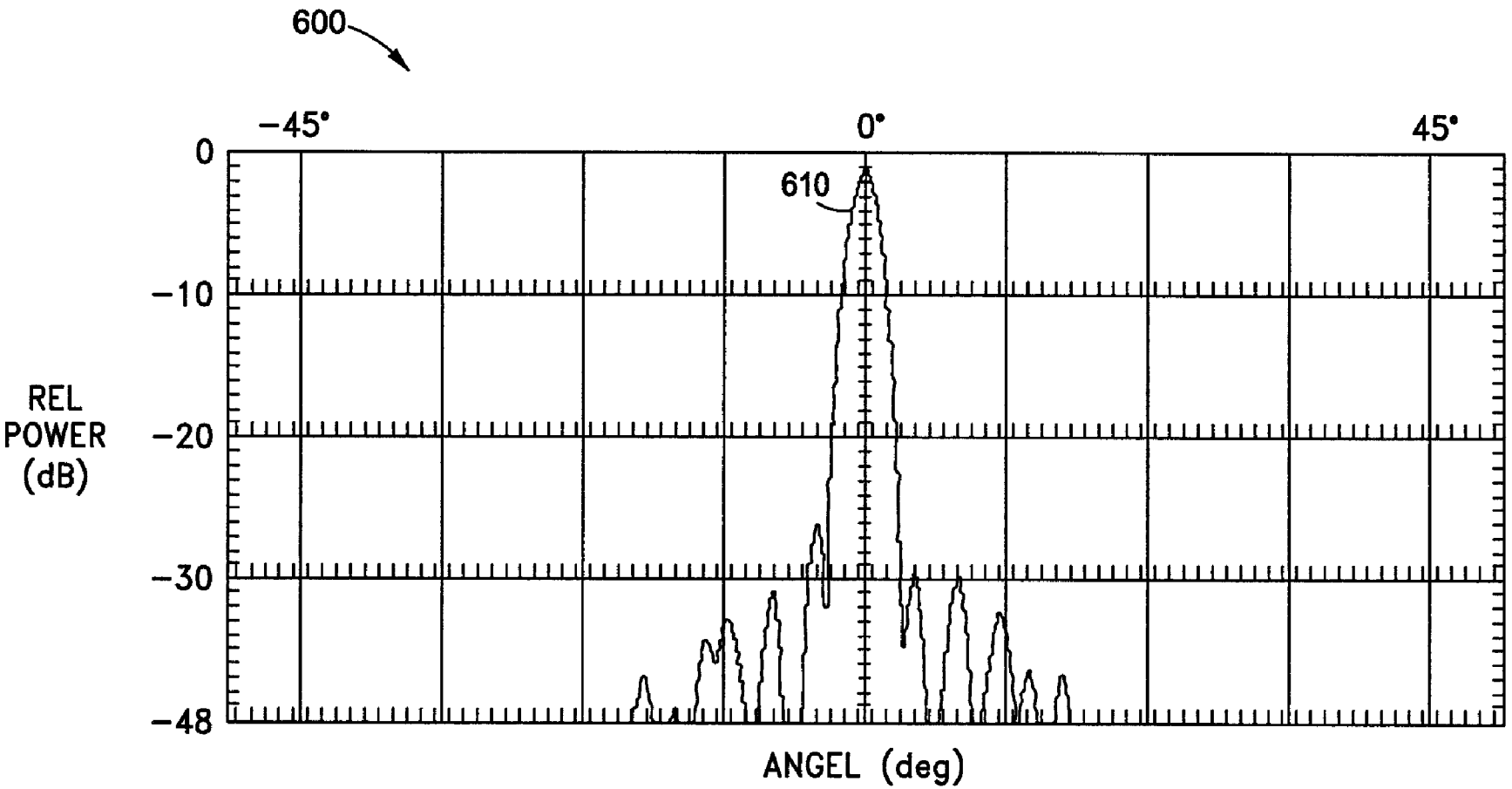
FIG. 6 depicts scan diagrams according to one embodiment, for the planar scanning antenna of FIG. 1.

Referring now to FIG. 6, a graphical representation 600 of planar scanning antenna beam strength 610 is depicted according to one embodiment of the invention. Graphical representation 600 provides a rectangular plot of relative power in decibels (dB) with respect to antenna azimuth degree. Planar scanning antenna beam strength 610 may be generated by collimated beam source (e.g., transducer module 400).

Figure 7A:
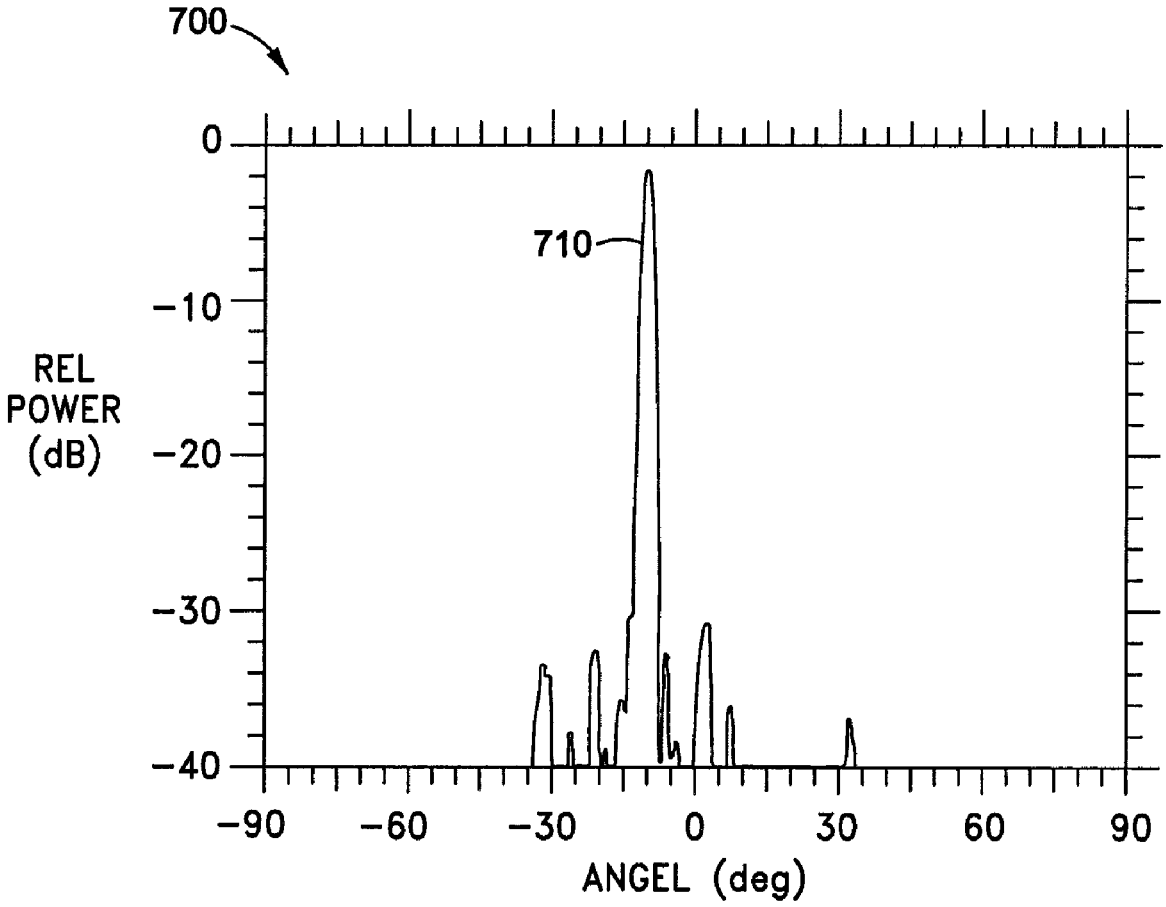
FIGS. 7A-C depict scan diagrams according to one embodiment, for the planar scanning antenna of FIG. 1.
Figure 7B:
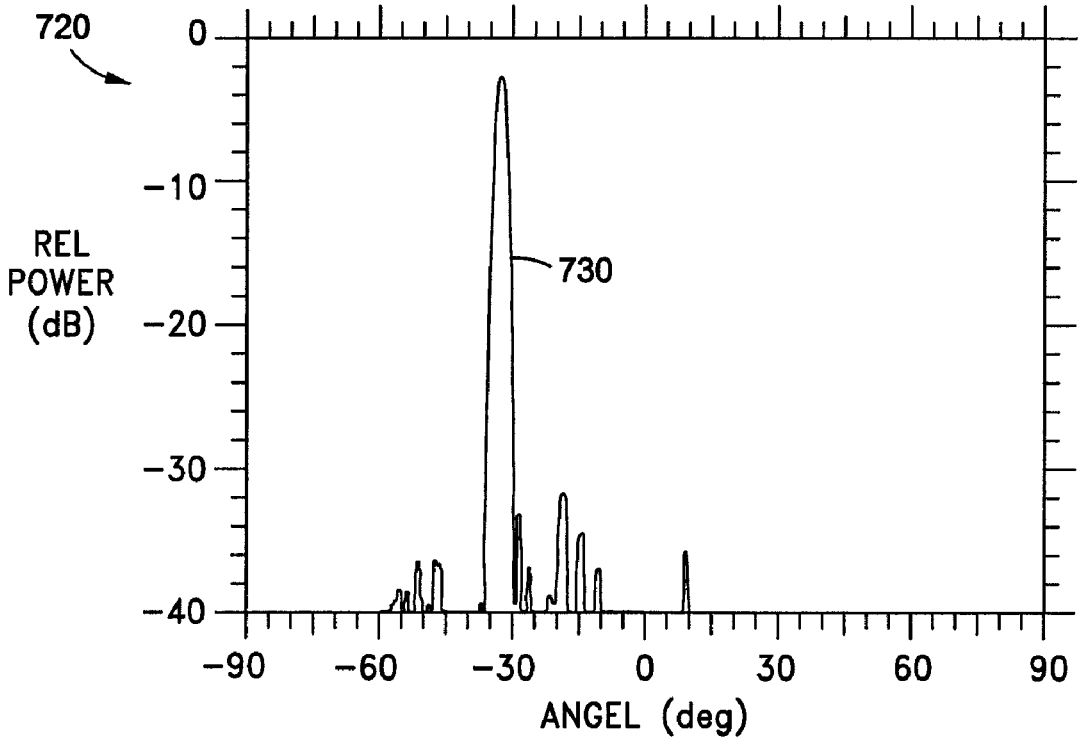
Figure 7C:
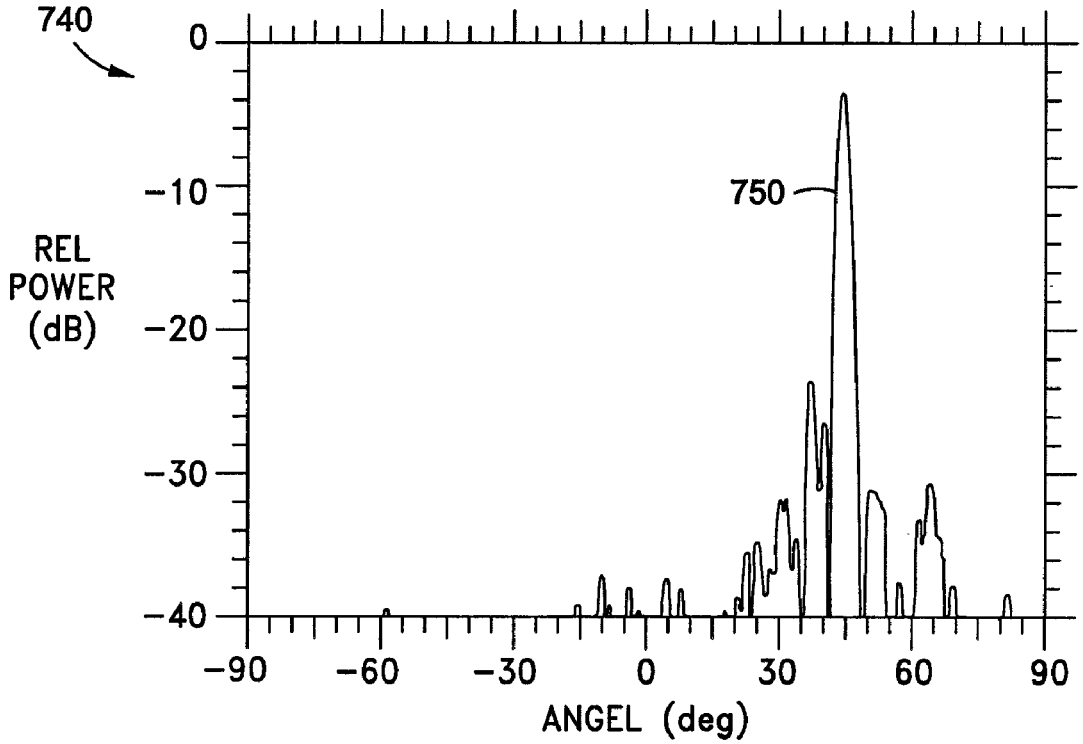

Referring now to FIGS. 7A-C, graphical representations of antenna scan patterns are provided according to one or more embodiments of the invention. FIG. 7A depicts a graphical representation 700 which plots relative power (dB) with respect to antenna azimuth degree. In one embodiment, antenna scan pattern 710 results by rotating first and second dielectric elements (e.g., first and second planar dielectric element 105 and 110) such that a scanning beam may be directed −10 degrees from an axis normal to the planar scanning antenna.

Referring now to FIG. 7B, graphical representation 720 provides antenna scan pattern 730 according to one embodiment of the invention. Antenna scan pattern 730 may be provided by rotating first and second dielectric elements (e.g., first and second planar dielectric element 105 and 110) such that a scanning beam may be directed −30 degrees from an axis normal to the planar scanning antenna. Referring now to FIG. 7C, graphical representation 740 provides antenna scan pattern 750 according to one embodiment of the invention. In one embodiment, antenna scan pattern 750 may be provided by rotating first and second dielectric elements (e.g., first and second planar dielectric element 105 and 110) such that a scanning beam may be directed +33 from an axis normal to the planar scanning antenna. It should further be appreciated that antenna structure of one embodiment of the invention may be configured to provide a continuous scan over a conical region of ±45 degrees about the antenna structure normal.

Figure 8:
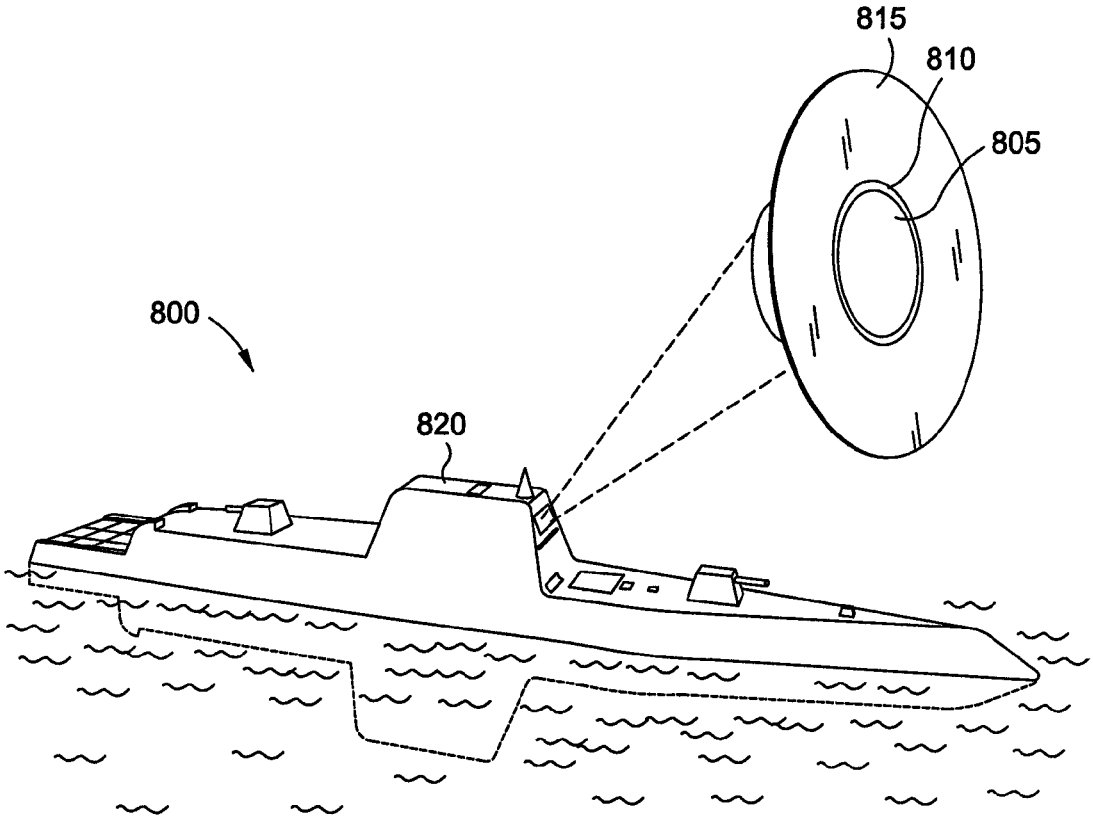
FIG. 8 depicts a flush mountable scanning antenna according to one embodiment, of the invention.

Referring now to FIG. 8, system 800 is provided for a flush mounting application of a planar scanning antenna (i.e., antenna structure 100) to surfaces or a prescribed geometry. Antenna requirements for shipboard applications requiring antennas to be placed flush with ship super structure 815 of the ship 820 may be satisfied by a planar scanning antenna configured in accordance with principles of the invention (e.g., antenna structure 100). In one embodiment of the invention, a scanning aperture 805 of a planar scanning antenna (e.g., antenna structure 100) may be flush mountable to surface super structure 815. According to another aspect of the invention, drive means 810 may be flush mountable to surface super structure 815. It may further be appreciated that planar scanning antenna, according to one or more embodiments of the invention, may be configured to conform to various surfaces.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. Trademarks and copyrights referred to herein are the property of their respective owners.

What is claimed is:

1. A planar scanning antenna, which comprises:

a transducer module configured to provide an electromagnetic beam;

a first planar dielectric element having an axis of rotation and configured to direct said electromagnetic energy, said first planar dielectric element being coupled to an inner cylindrical drive tube; and a second planar dielectric element oriented adjacent to said first planar dielectric element, having said axis of rotation and configured to direct said electromagnetic energy, said second planar dielectric element being coupled to an outer cylindrical drive tube;

a mounting structure positioning said first and second planar dielectric elements, said mounting structure comprising said inner drive tube and said outer drive tube, said outer drive tube concentrically overlying said inner cylindrical drive tube; and a drive means for positioning said first planar dielectric element independently from said second planar dielectric element using said inner and outer cylindrical drive tubes.

2. The planar scanning antenna of claim 1, wherein said transducer module comprises a collimated beam source.

3. The planar scanning antenna of claim 2, wherein said collimated beam source comprises at least one of a slotted array, a parabolic reflector, and a micropatch array.

4. The planar scanning antenna of claim 2, wherein said transducer module comprises a twist cassegrain configuration.

5. The planar scanning antenna of claim 1, wherein said drive means further provides independent rotation of said first and second planar dielectric elements about an axis normal to said transducer module.

6. The planar scanning antenna of claim 1, wherein at least one of said first and second planar dielectric elements is a stepped lens.

7. The planar scanning antenna of claim 1, wherein said transducer module comprises an electromagnetically loading structure.

8. The planar scanning antenna of a claim 1, wherein said mounting structure is configured to be flush mounted.

9. The planar scanning antenna of claim 1, wherein said antenna is configured to provide an antenna scan pattern defined by $$(\sin(\theta_{max}))=\sin(\theta_{element\ 1})+\sin(\theta_{element\ 2})),$$

wherein, $\theta_{element\ 1}$=angular offset imparted by the first planar dielectric element, $\theta_{element\ 2}$=angular offset imparted by the second planar dielectric element, and $\theta_{max}$=resultant angular offset.

10. A mounting structure which comprises:

a transducer module comprising an electromagnetically loading structure, said transducer module configured to provide at least one of generating and receiving a beam source;

a first planar dielectric element configured to direct electromagnetic energy, said first planar dielectric element being coupled to an inner cylindrical drive tube;

a second planar dielectric element configured to direct electromagnetic energy, said second planar dielectric element being coupled to an outer cylindrical drive tube, said outer cylindrical drive tube concentrically overlying said inner cylindrical drive tube; and a drive module configured to independently position said first planar dielectric element and said second planar dielectric element using said inner and outer cylindrical drive tubes such that said first and second planar dielectric elements direct said beam source.

11. The mounting structure of claim 10, wherein said beam source is at least one a slotted array, a parabolic reflector, a collimated beam source, and a micropatch array.

12. The mounting structure of claim 10, wherein said drive module provides independent rotation of said first and second planar dielectric elements.

13. The mounting structure of claim 10, wherein at least one of said first and second planar dielectric elements comprises a stepped lens.

14. The mounting structure of claim 10, wherein said beam source comprises a FLAPS technology surface.

15. The mounting structure of claim 10, wherein said beam source comprises a foam spacer.

16. The mounting structure of claim 10, wherein said beam source is a twist cassegrain configuration.

17. The mounting structure of claim 10, wherein said mounting structure is configured to be flush mounted.

18. The mounting structure of claim 10, wherein said first and second planar dielectric elements are configured to provide an antenna scan pattern defined by $$(\sin(\theta_{max}))=\sin(\theta_{element\ 1})+\sin(\theta_{element\ 2})),$$

wherein, $\theta_{element\ 1}$=angular offset imparted by the first planar dielectric element, $\theta_{element\ 2}$=angular offset imparted by the second planar dielectric element, and $\theta_{max}$=resultant angular offset.

* * * * *

UNITED STATES PATENT AND TRADEMARK OFFICE

CERTIFICATE OF CORRECTION

PATENT NO. : 7,868,839 B2
APPLICATION NO. : 11/933103
DATED : January 11, 2011
INVENTOR(S) : Daniel G. Gonzalez It is certified that error appears in the above-identified patent and that said Letters Patent is hereby corrected as shown below:

In the Specifications:

Column 3, line 66:

Now reads: "inner tube 225 and outer drive tube 225"

Should read: -- inner tube 225 and outer drive tube 230 --

Column 4, line 11:

Now reads: "a feedhom (not shown)"

Should read: -- a feedhorn (not shown) --

Column 4, line 34:

Now reads: "feedhom 415. In one embodiment, feedhom 415 may"

Should read: -- feedhorn 415. In one embodiment, feedhorn 415 may --

Signed and Sealed this
Twenty-first Day of August, 2012

David J. Kappos

David J. Kappos
*Director of the United States Patent and Trademark Office*